US011029040B2

(12) United States Patent
Lord et al.

(10) Patent No.: US 11,029,040 B2
(45) Date of Patent: Jun. 8, 2021

(54) HEATING SYSTEM INCLUDING A REFRIGERANT BOILER

(71) Applicant: Carrier Corporation, Jupiter, FL (US)

(72) Inventors: Richard G. Lord, Murfreesboro, TN (US); Michael F. Taras, Fayetteville, NY (US); Alexander Lifson, Manlius, NY (US); Eugene Duane Daddis, Jr., Manlius, NY (US); Ludgina Fils Dieujuste, Odenton, MD (US); Kenneth J. Nieva, Baldwinsvile, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 493 days.

(21) Appl. No.: 15/925,058

(22) Filed: Mar. 19, 2018

(65) Prior Publication Data

US 2018/0209666 A1 Jul. 26, 2018

Related U.S. Application Data

(62) Division of application No. 13/677,440, filed on Nov. 15, 2012, now abandoned.

(Continued)

(51) Int. Cl.

*F24D 19/00* (2006.01)
*F24D 19/10* (2006.01)

(Continued)

(52) U.S. Cl.

CPC ..... *F24D 19/00* (2013.01); *F22B 35/00* (2013.01); *F24D 7/00* (2013.01); *F24D 19/1015* (2013.01);

(Continued)

(58) Field of Classification Search

CPC ..... F24D 19/00; F24D 19/1015; F24D 2200/046; F24D 2200/04; F24D 7/00; F22B 35/00; F25B 23/006

(Continued)

(56) References Cited

U.S. PATENT DOCUMENTS 1,093,722 A 4/1914 Osbourn
1,189,806 A 7/1916 Gibson (Continued)

FOREIGN PATENT DOCUMENTS

EP 1136764 A2 9/2001
EP 1746370 A2 1/2007

(Continued)

OTHER PUBLICATIONS

Final Office Action for U.S. Appl. No. 13/677,440, dated Dec. 28, 2017, 9 pages.

(Continued)

*Primary Examiner* — Kenneth J Hansen
*Assistant Examiner* — Phillip Decker
(74) *Attorney, Agent, or Firm* — Cantor Colburn LLP

(57) ABSTRACT

A heating system includes a refrigerant boiler including a heat source for heating a refrigerant from a liquid state to a vapor state, a boiler outlet and a boiler inlet; a heat exchanger in fluid communication with the refrigerant boiler, the heat exchanger including a upper manifold having a heat exchanger inlet coupled to the boiler outlet, a lower manifold having a heat exchanger outlet coupled to the boiler inlet and a plurality of tubes connecting the upper manifold and the lower manifold, wherein refrigerant passes from the upper manifold to the lower manifold via gravity; and a fan moving air over the heat exchanger to define supply air for a space to be heated.

18 Claims, 11 Drawing Sheets

Related U.S. Application Data

(60) Provisional application No. 61/561,309, filed on Nov. 18, 2011.

(51) Int. Cl.
*F24D 7/00* (2006.01)
*F22B 35/00* (2006.01)
*F25B 23/00* (2006.01)

(52) U.S. Cl.
CPC ..... *F25B 23/006* (2013.01); *F24D 2200/04* (2013.01); *F24D 2200/046* (2013.01)

(58) Field of Classification Search
USPC ..... 237/2 A
See application file for complete search history.

(56) References Cited

U.S. PATENT DOCUMENTS 1,404,995 A 1/1922 Mouat
1,942,831 A * 1/1934 Perry ..... F24D 1/00 237/74
1,946,676 A 2/1934 Eaton
2,081,831 A * 5/1937 Moore ..... F24D 19/1009 237/8 R
2,213,053 A * 8/1940 Russell ..... B61D 27/0036 237/6
2,321,390 A * 6/1943 Juzi ..... F22B 29/08 122/1 B
2,694,526 A * 11/1954 Ernst ..... F24D 19/1066 237/5
2,721,706 A * 10/1955 Schoerner ..... F24D 19/1006 237/8 R
2,730,305 A 1/1956 Chadwick
2,744,688 A * 5/1956 Ross ..... G05D 23/1931 236/46 R
2,774,848 A * 12/1956 Tidd ..... G05D 23/275 337/322
2,868,461 A * 1/1959 Gaddis ..... F24D 19/1003 237/9 R
3,496,992 A 2/1970 Leonard et al.
3,511,310 A 5/1970 Van Loo
3,927,299 A 12/1975 Sturgis
3,989,183 A * 11/1976 Gustafsson ..... F24D 3/18 237/2 B
4,147,302 A * 4/1979 Gray ..... F24D 1/02 236/37
4,223,205 A 9/1980 Sturgis
4,301,662 A * 11/1981 Whitnah ..... F25B 1/08 237/1 R
4,343,987 A * 8/1982 Schimbke ..... F22B 1/30 122/382
4,465,456 A * 8/1984 Hynek ..... F23N 1/025 431/62
4,523,437 A 6/1985 Briley
4,584,987 A 4/1986 Rotili
4,660,511 A * 4/1987 Anderson ..... F01K 23/04 122/1 C
4,708,287 A * 11/1987 De Wit ..... G05D 23/1932 237/8 R
4,918,933 A * 4/1990 Dyer ..... F24H 4/00 62/79
5,337,577 A 8/1994 Eiermann
5,779,143 A * 7/1998 Michaud ..... F24D 19/1009 237/56
6,006,538 A 12/1999 Prueitt
6,394,361 B1 * 5/2002 Fridmann ..... F24D 19/1015 237/8 A
6,546,898 B1 * 4/2003 Rocheleau ..... F24D 3/1058 122/235.29
7,438,122 B2 10/2008 Hawranek
7,637,233 B2 * 12/2009 Albrecht ..... F22D 1/12 122/467
7,819,334 B2 * 10/2010 Pouchak ..... F24D 12/02 237/8 R
8,042,495 B2 * 10/2011 Min ..... F24D 19/1066 122/18.1
8,122,715 B2 * 2/2012 Rapitis ..... F01K 25/08 60/513
8,474,729 B2 * 7/2013 Kaneiwa ..... F24B 1/1808 237/2 A
2003/0023467 A1 1/2003 Moldovan
2003/0079697 A1 * 5/2003 Rocheleau ..... F24D 3/1058 122/235.29
2004/0011505 A1 1/2004 Park et al.
2007/0266708 A1 * 11/2007 Rapitis ..... F01K 25/08 60/651
2008/0110601 A1 * 5/2008 Baldini ..... F24H 4/02 165/111
2008/0173723 A1 * 7/2008 Zhadanovsky ..... F24D 1/00 237/67
2009/0025418 A1 1/2009 De La Cruz
2009/0056347 A1 3/2009 Kinkel
2009/0229282 A1 9/2009 Taras
2010/0126432 A1 * 5/2010 Eberle ..... F28D 21/0007 122/20 B
2010/0154421 A1 * 6/2010 Vaisman ..... F01K 25/10 60/670
2010/0199714 A1 8/2010 Yanik et al.
2010/0326646 A1 * 12/2010 Kim ..... F24D 19/1015 165/287
2011/0198406 A1 8/2011 Zhadanovsky
2011/0296838 A1 * 12/2011 Ogai ..... F23N 5/003 60/670
2013/0256423 A1 10/2013 Lord

FOREIGN PATENT DOCUMENTS

WO 2008106526 A1 9/2008
WO 2009018150 A1 2/2009
WO 2009023756 A2 2/2009
WO 2011014719 A1 2/2011

OTHER PUBLICATIONS

Final Office Action for U.S. Appl. No. 13/677,440, dated Nov. 2, 2016, 8 pages.
Non Final Office Action for U.S. Appl. No. 13/677,440, dated Apr. 13, 2016, 11 pages.
Non Final Office Action for U.S. Appl. No. 13/677,440, dated Jun. 21, 2017, 8 pages.

* cited by examiner

HEATING SYSTEM INCLUDING A REFRIGERANT BOILER

CROSS-REFERENCE TO RELATED APPLICATIONS

This application is a divisional of U.S. patent application Ser. No. 13/677,440, filed Nov. 15, 2012, which claims the benefit of U.S. provisional patent application Ser. No. 61/561,309 filed Nov. 18, 2011, the entire contents of which are incorporated herein by reference.

BACKGROUND OF THE INVENTION

Embodiments of the invention relate generally to air conditioning systems, and in particular to an air heating system using a refrigerant boiler.

Packaged rooftop air conditioning systems are used in the art for air conditioning (e.g., heating or cooling) of a building. Existing gas heat technology in use for most packaged equipment utilizes tubular gas heat exchangers with an induced draft combustion system. One downside of such designs is that the heat exchangers must be located on the discharge side of the fan, are very sensitive to airflow and system configuration changes and very expensive and time consuming to qualify. The combustion module also requires significant space that results in larger unit sizes than required for the electric heat option. For outdoor weatherized applications, the technology is currently limited to non-condensing furnaces (<81% efficiency) due to added air side pressure drop, corrosion issues and disposal of the condensate. In current packaged rooftops, a direct gas heat exchanger system is used where gas is burned inside a tubular or similar heat exchanger located in the indoor airflow leaving the supply fan. The designs are very cost effective, but once again, are very time-consuming to qualify and require extensive testing for each unit size and airflow configuration. As such, improvements in air heating systems would be well received in the art.

BRIEF DESCRIPTION OF THE INVENTION

According to an exemplary embodiment of the present invention a heating system includes a refrigerant boiler including a heat source for heating a refrigerant from a liquid state to a vapor state, a boiler outlet and a boiler inlet; a heat exchanger in fluid communication with the refrigerant boiler, the heat exchanger including a upper manifold having a heat exchanger inlet coupled to the boiler outlet, a lower manifold having a heat exchanger outlet coupled to the boiler inlet and a plurality of tubes connecting the upper manifold and the lower manifold, wherein refrigerant passes from the upper manifold to the lower manifold via gravity; and a fan moving air over the heat exchanger to define supply air for a space to be heated.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
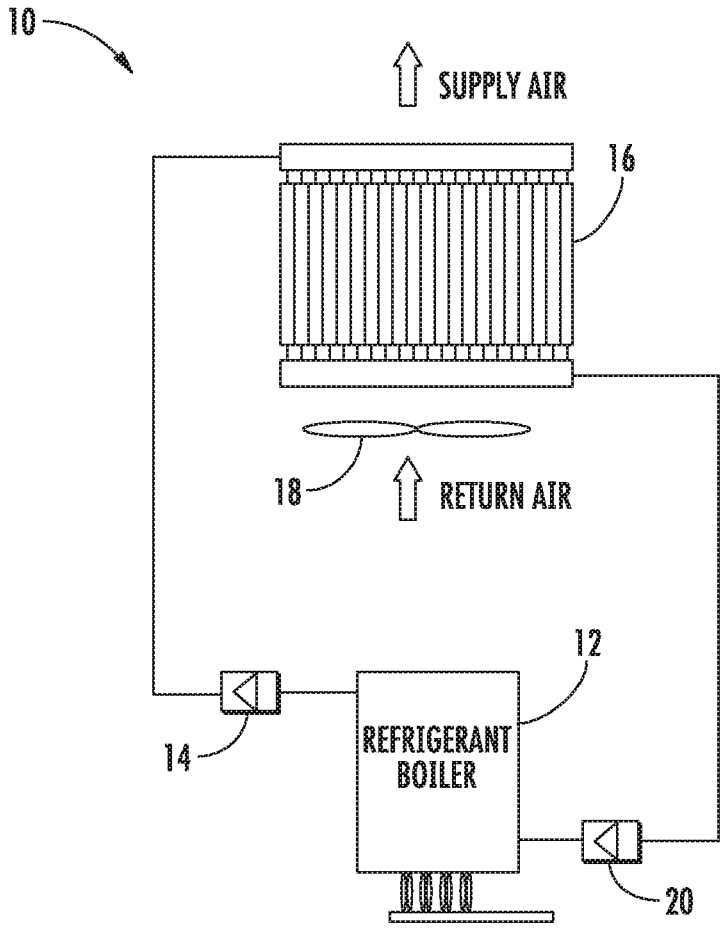
FIGS. 1-8 depict heating systems in exemplary embodiments.

FIG. 1 depicts a heating system 10 in an exemplary embodiment. Heating system 10 may be used as part of a packaged rooftop air conditioning system. Heating system 10 includes a boiler 12 for boiling a refrigerant to change state of the refrigerant from liquid to gas. The refrigerant used may be any known type refrigerant, such as R134a. Boiler 12 may utilize a gas heater (e.g., inshot burner), electric heater, infrared heater, etc. to apply heat to a refrigerant in a coil within boiler 12. Boiler 12 heats the refrigerant from a liquid to a vapor. Pressure created by the boiling refrigerant and thermo-siphon action are used to circulate the vapor refrigerant from a boiler outlet through a check valve 14 to a heat exchanger 16, also referred to as a condenser. At heat exchanger 16, the vapor refrigerant condenses and heat is released. Return air (which may include a mix of outside air) is directed over the heat exchanger 16 by a fan 18. Air passing over heat exchanger 16 is heated and provided as supply air to a spaced to be heated. Liquid refrigerant from heat exchanger 16 flows through a pressure regulator 20 back to an inlet of boiler 12, to continue the cycle. As discussed in further detail herein, heat exchanger 16 is a vertically mounted, gravity operated heat exchanger allowing refrigerant to flow back to boiler 12 via gravity. The system configuration in FIG. 1 allows the heat exchanger 16 to be located in any position in the unit and allows for more creative and compact designs. System 10 may use 2L class semi-flammable refrigerants, due to the relatively lower temperatures used to boil the refrigerant in boiler 12.

Figure 2:
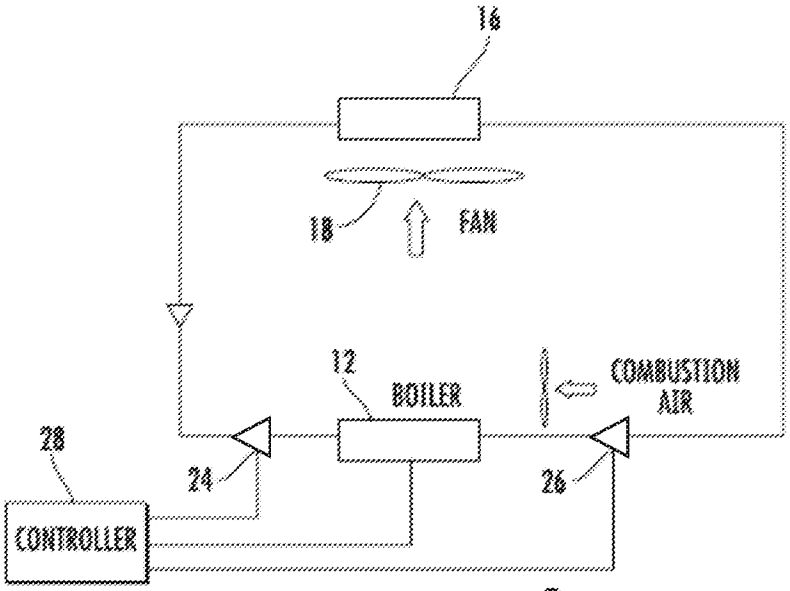

FIG. 2 depicts a heating system in an alternate embodiment. Typical refrigerant boiler installations rely on a dedicated pump to move refrigerant through the system. As described above, boiler 12 changes refrigerant from a liquid state to a vapor state. The vapor refrigerant is provided to heat exchanger 16 to condense and release heat. The embodiment of FIG. 2 uses valves 24 and 26 to control the flow of refrigerant through the system. Valves 24 and 26 may be solenoid valves opened and closed under commands from controller 28. In an initial state, valves 24 and 26 are both closed, which traps the refrigerant in boiler 12. As more heat is added to the trapped refrigerant by combustion, refrigerant temperature and pressure increase. Controller 28 monitors pressure and/or temperature in boiler 12 via sensors. When the refrigerant pressure in the trapped volume has increased to a specified value, the downstream valve 26 is opened and high pressure refrigerant is expelled into the system propelling the refrigerant toward the heat exchanger 16. Shortly after the downstream valve 26 is opened, controller 28 opens upstream valve 24 to let the refrigerant be returned back into boiler 12. After both valves 24 and 26 are open for a predetermined period of time, controller 28 closes both valves 24 and 26 and the cycle repeats. The timing of opening/closing of the valves can be controlled based on temperature and/or pressure measurements in the boiler 12. This timing can be set at the predetermined interval at the factory or it can be adjusted in the field based on the operating conditions. The embodiment of FIG. 2 eliminates the need for a dedicated pump to pump the refrigerant through the system.

Figure 3:
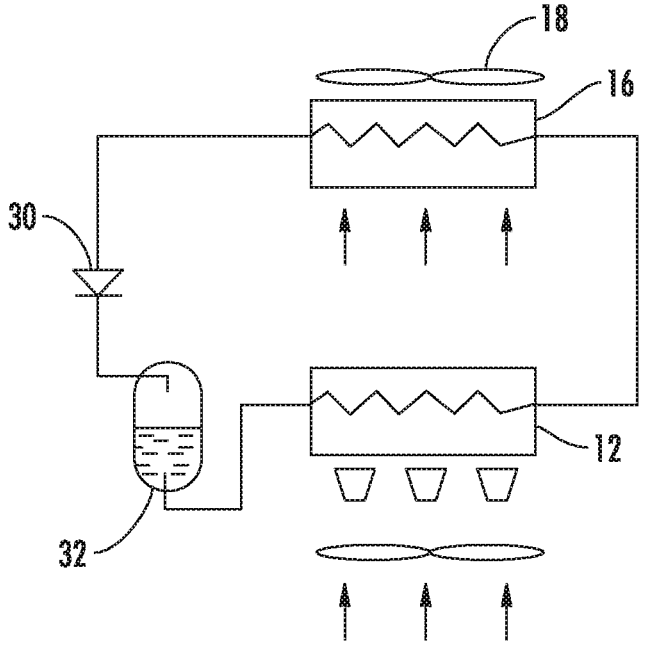

FIG. 3 depicts a heating system in an alternate embodiment. One challenge in operation of refrigerant boiler systems is control of the system refrigerant charge. It is known that the amount of refrigerant needed for most efficient system operation varies with respect to the refrigerant boiler operating condition. If there is too little refrigerant in the system, then the system may not perform efficiently because there is not enough refrigerant circulating through the system to provide an effective level of heating. If there is too much refrigerant in the system, then significant parasitic flow pressure losses might be present, causing the system performance to deteriorate. Since different operating conditions require different amounts of refrigerant for the most efficient operation, it is beneficial to adjust the amount of the circulating refrigerant based on the operating condition. Further, the required heating capacity of a heating system varies appreciably and strongly depends on environmental and operational conditions as well as heating demands in the climate-controlled space. Therefore, the refrigerant charge in the heating closed-loop circuit of the system needs to be adjusted accordingly.

The embodiment of FIG. 3 includes an accumulator 32 to manage the refrigerant charge. Accumulator 32 is positioned, for instance, between the outlet of heat exchanger 16 and the inlet of boiler 12. A check valve 30 is positioned upstream of accumulator 32 so that accumulator 32 is positioned on the low-pressure side of the refrigerant path. Accumulator 32 may be located in other positions, such as on a branch line and valved on and off when it is required.

Figure 4:
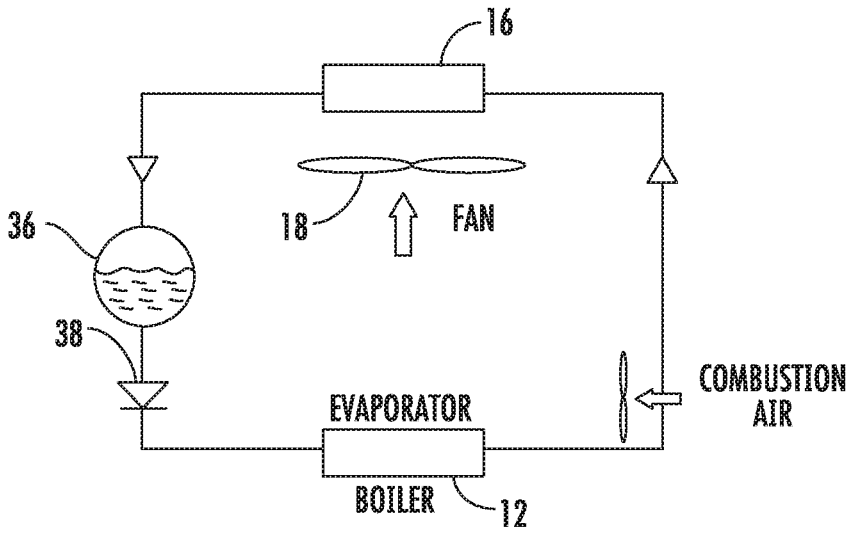

FIG. 4 depicts a heating system in an alternate embodiment for managing refrigerant charge. The system of FIG. 4 includes a receiver 36 located between the outlet of heat exchanger 16 and the inlet of boiler 12. A check valve 38 is positioned downstream of the receiver 36, so that receiver 36 is positioned on the high-pressure side of the refrigerant path. If the system has too much refrigerant, then the excess refrigerant would be stored in receiver 36 and not be circulated through the system. Since the excess refrigerant is stored in receiver 36, then the refrigerant boiler system can be operated more efficiently without experiencing extra parasitic pressure losses. The size of receiver 36 can be selected based on the maximum variations of the circulating refrigerant in the system.

Figure 5:
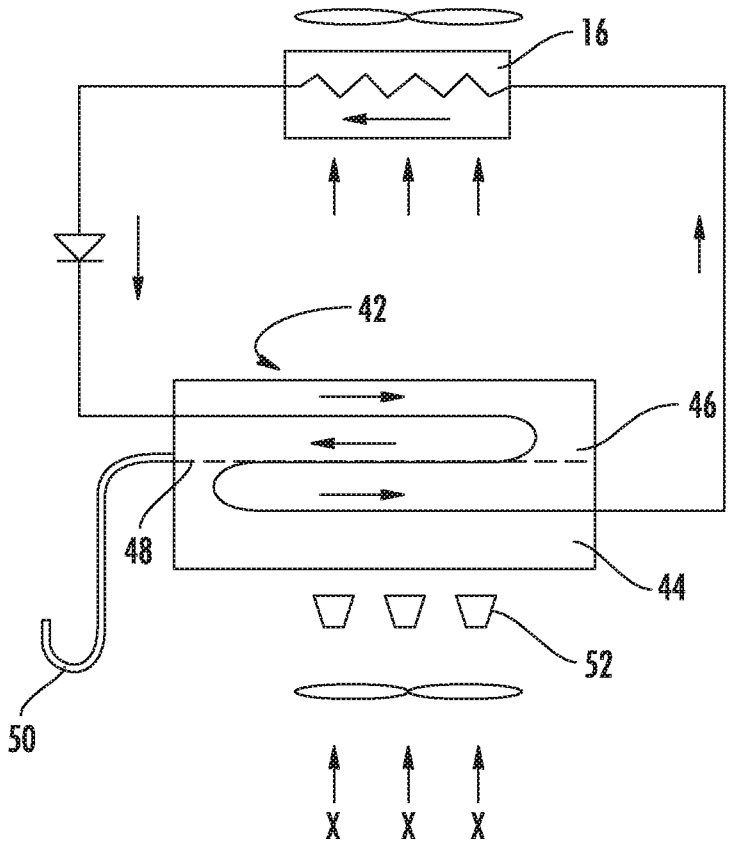

FIG. 5 depicts a heating system in an alternate embodiment. It is desirable to improve efficiency of the refrigerant boiler, especially since the flue gas exiting the refrigerant boiler still has high temperature, and its heating potential is essentially wasted. It is known from the gas furnace experience that a condensing furnace would have a much higher efficiency. The embodiment of FIG. 5 uses a boiler 42 having two heat exchanger sections 44 and 46 arranged in a counterflow manner, with respect to the flue gas flow, shown by arrows labeled X. A first heat exchanger section 44 is positioned closer to a burner 52 and second heat exchanger section 46 is positioned farther from the burner 52 than first heat exchanger section 44. The second heat exchanger section 46 serves as a condensation section of the heat exchanger, where condensation from the flue gas forms on the second heat exchanger section 46. A tray 48 is used to collect condensation and a condensation drain 50 directs a flue gas condensate from tray 48 away from the unit.

Figure 6:
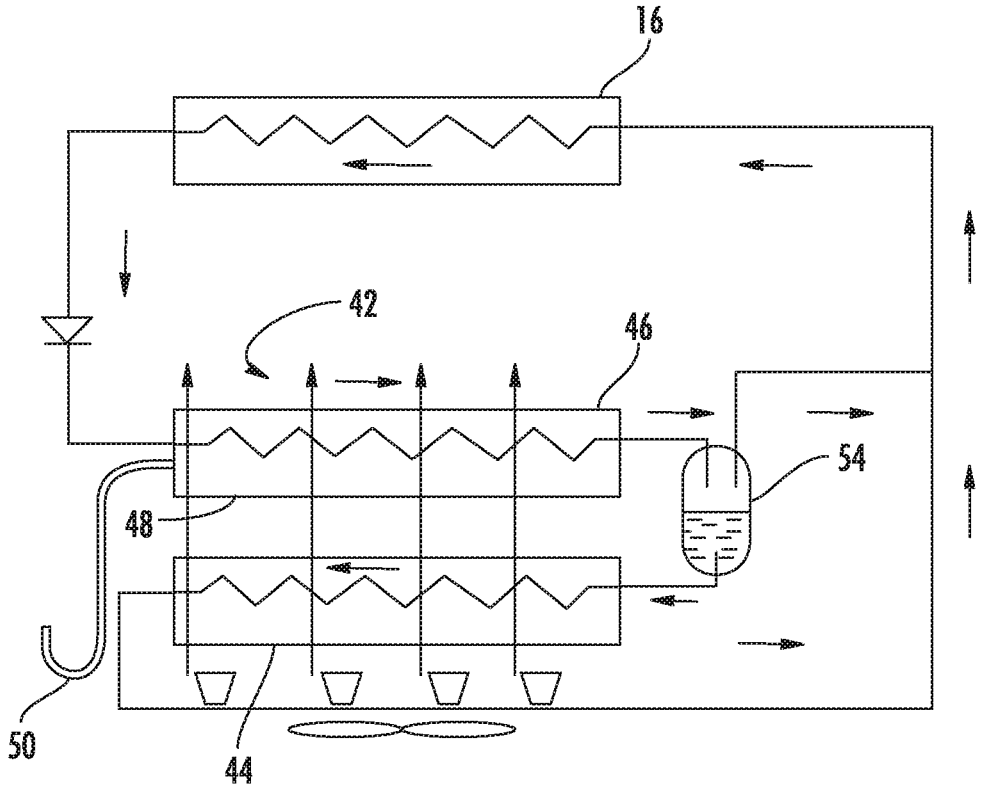

FIG. 6 is an alternate version of the embodiment of FIG. 5, in which the first heat exchanger section 44 and second heat exchanger section 46 are represented by two separate heat exchangers. In this embodiment, the efficiency of the refrigerant boiler 42 can be improved even further by placing a liquid-vapor separator 54 in between the two heat exchanger sections 46 and 44. The upper portion of the liquid-vapor separator 54 (i.e., the part containing vapor) is coupled to the refrigerant path downstream of refrigerant boiler 42 which is coupled to the inlet of heat exchanger 16. The lower portion of the liquid-vapor separator 54 (i.e., the part containing liquid) is coupled to an inlet of the first heat exchanger section 44. Condensate drain 50 directs a flue gas condensate from tray 48 in second heat exchanger section 46 away from the unit.

Figure 7:
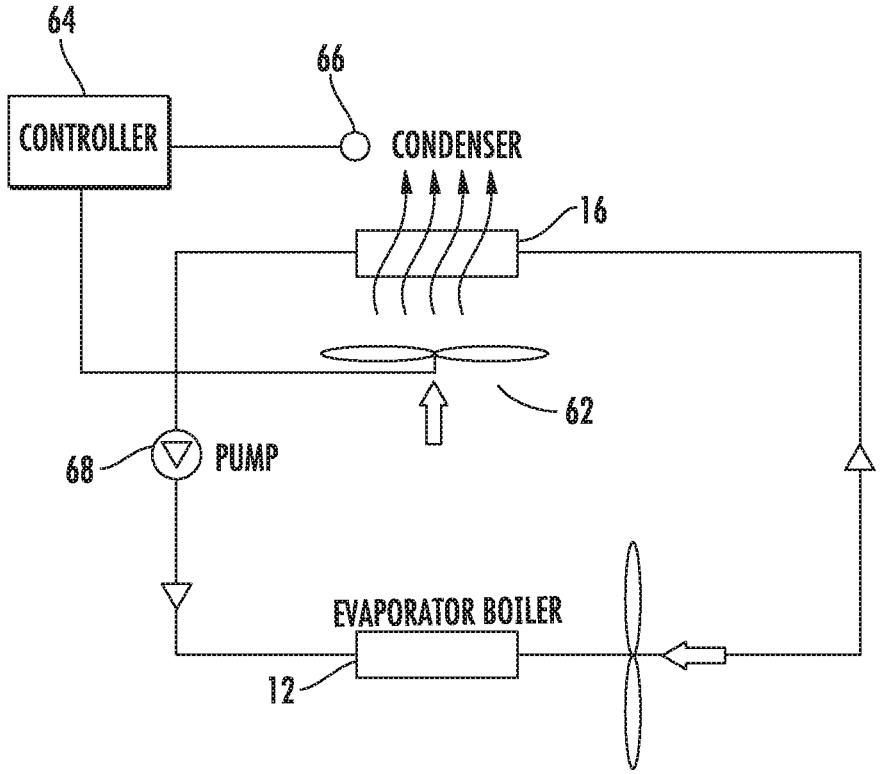

FIG. 7 depicts a heating system in an alternate embodiment. One phenomenon associated with refrigerant boiler 12 is referred to as cold blow. Cold blow occurs when the mass flow of air blowing over the heat exchanger 16 is excessively high, which results in less than desirable preheating of the air as it passes over the condenser coils. However, if the amount of air blowing over the condenser is too low, then there is not enough heating capacity generated to heat the environment. Therefore, the refrigerant boiler design should prevent cold blow while at the same time delivering a sufficient amount of heated air.

The embodiment of FIG. 7 addresses the effects of cold blow through the use of a variable speed condenser fan 62 controlled by controller 64. If it is determined that the cold blow is present, then fan 62 is slowed down to increase the amount of the air as it passes over the coil of condenser 16. Fan 62 may be implemented using a variable frequency fan controlled by variable frequency drive (VFD) signal from controller 64. Alternatively, condenser fan 62 can be a two speed fan. When the cold blow is present, the fan is switched to a lower speed motor operation. The fan speed can be controlled by controller 62 based on the temperature of the air passing over the coil as detected by temperature sensor 66 that provides a temperature signal to controller 64. If the temperature of the return air is below a certain threshold, then the fan speed is slowed until the temperature reaches the acceptable value. FIG. 7 also depicts a pump 68 that may be used to circulate refrigerant through the system.

Figure 8:
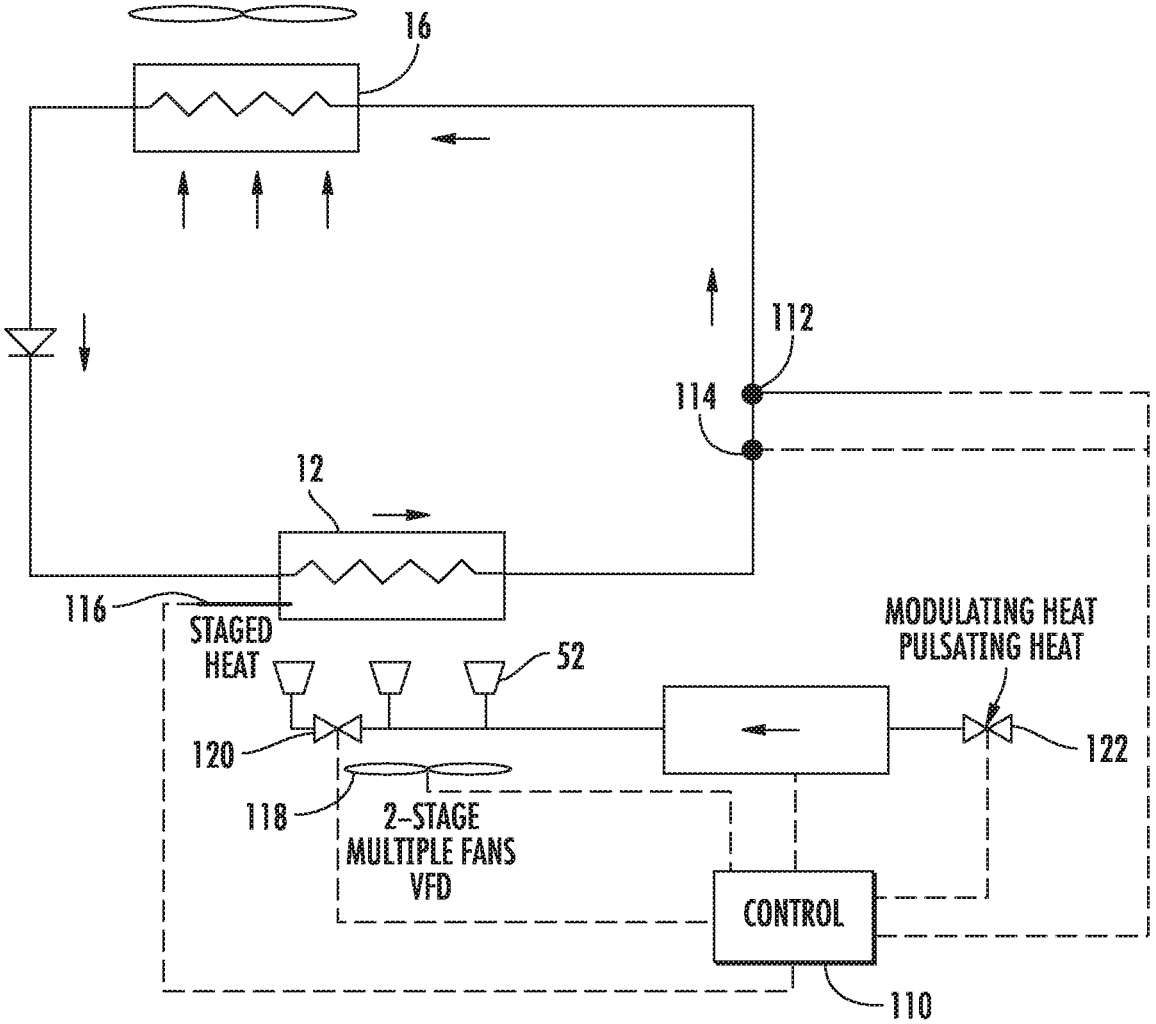

FIG. 8 depicts a heating system in an alternate embodiment. The embodiment of FIG. 8 provides control of refrigerant boiler 12 through a number of sensors and a controller 110. Temperature sensor 112 and pressure sensor 114 monitor temperature and pressure of vapor refrigerant exiting refrigerant boiler 12, and provide a temperature signal and pressure signal to controller 110. A refrigerant level sensor 116 senses the level of refrigerant in boiler 12 and provides a refrigerant level signal to controller 110. Controller 110 controls boiler 12 by controlling heat generated by burner 52 and/or by controlling flue gas fan 118.

The output of burner 52 may be controlled in a number of ways. Burner 52 may be a multi-stage burner having a burner stage valve 120 electrically controlled by controller 110. Controller 110 opens burner stage valve 120 to increase the heat output of burner 52 by effectively adding another burner stage. Conversely, controller 110 closes burner stage valve 120 to decrease heat output of burner 52. Burner stage valve 120 may also be placed in a position between open and closed, providing variable fuel flow to the additional burner stage.

Fuel (e.g., gas) flow to burner 52 may also be controlled by metering the flow of fuel to burner 52. Controller 110 controls a fuel flow control device 122 to affect the flow of fuel to burner 52. Fuel flow control device 122 is electronically controlled by controller 110. Fuel flow control device 122 may be a valve that can be opened, closed, or positioned in any number of positions between open and closed. Fuel flow control device 122 may also implement more complex metering functions, such as modulating fuel flow or pulsating fuel flow to burner 52 in response to control signals from controller 110.

The flow of flue gas over the heat exchanger in boiler 12 is controlled through flue gas fan 118. Control of flue gas fan 118 may be implemented in a number of ways. In one embodiment, flue gas fan 118 may be implemented using a variable frequency fan controlled by variable frequency drive (VFD) signal from controller 110. Alternatively, flue gas fan 118 may be a two speed fan electronically controlled by controller 110. Alternatively, multiple flue gas fans may be used, with controller 110 turning individual fans on and off to achieve a desired flue gas flow over the heat exchanger in boiler 12.

In operation, controller 110 receives the temperature signal, pressure signal and refrigerant level signal from sensors 112, 114 and 116, respectively. Controller 110 then controls the heat at burner 52 and flue gas flow as described above to maintain the temperature and pressure of vapor refrigerant exiting boiler 12 and the refrigerant level in boiler 12 within acceptable operational ranges.

Figure 9:
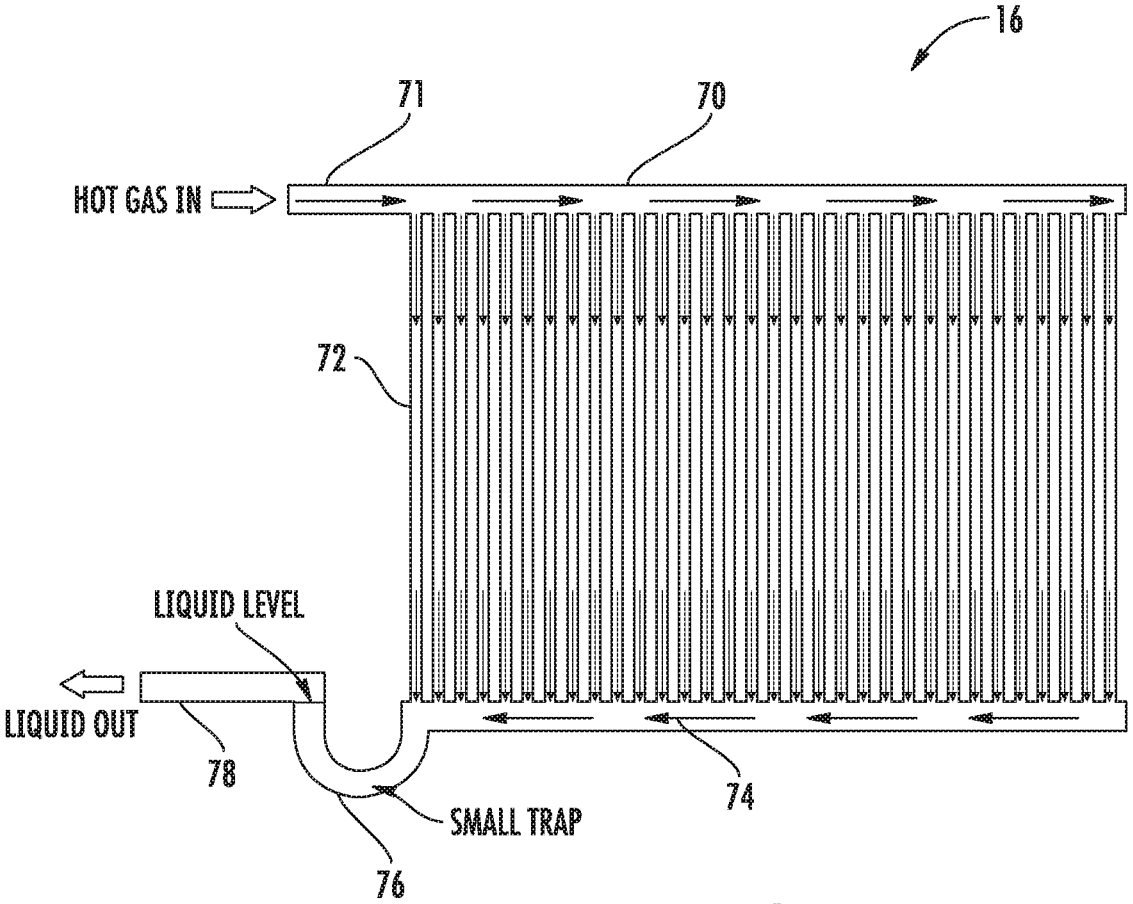
FIGS. 9-11 depict heat exchangers in exemplary embodiments.

FIG. 9 depicts condenser 16 in an exemplary embodiment. Condenser 12 includes an inlet 71 to an upper manifold 70 for receiving vapor refrigerant from boiler 12. The vapor refrigerant flows to a plurality of vertical tubes 72, condenses in the vertical tubes and travels by gravity down vertical tubes 72. A lower manifold 74 collects the liquid refrigerant, which flows by gravity through a trap 76 to an outlet 78 and back to the boiler 12. The vertical tube condenser utilizes gravity to help circulate refrigerant throughout the system. Hence, a circulation pump is not required. The trap 76 insures that the refrigerant flow will be in the preferred direction to maximize refrigerant flow. The trap 76 is located at the exit of the lower manifold 74 and provides a barrier for vapor refrigerant from entering heat exchanger 16 via the lower manifold 74. This resistance results in forcing the vapor refrigerant to enter through the top manifold 70, hence resulting in an orderly progression of the refrigerant through heat exchanger 16 as it condenses.

Figure 10:
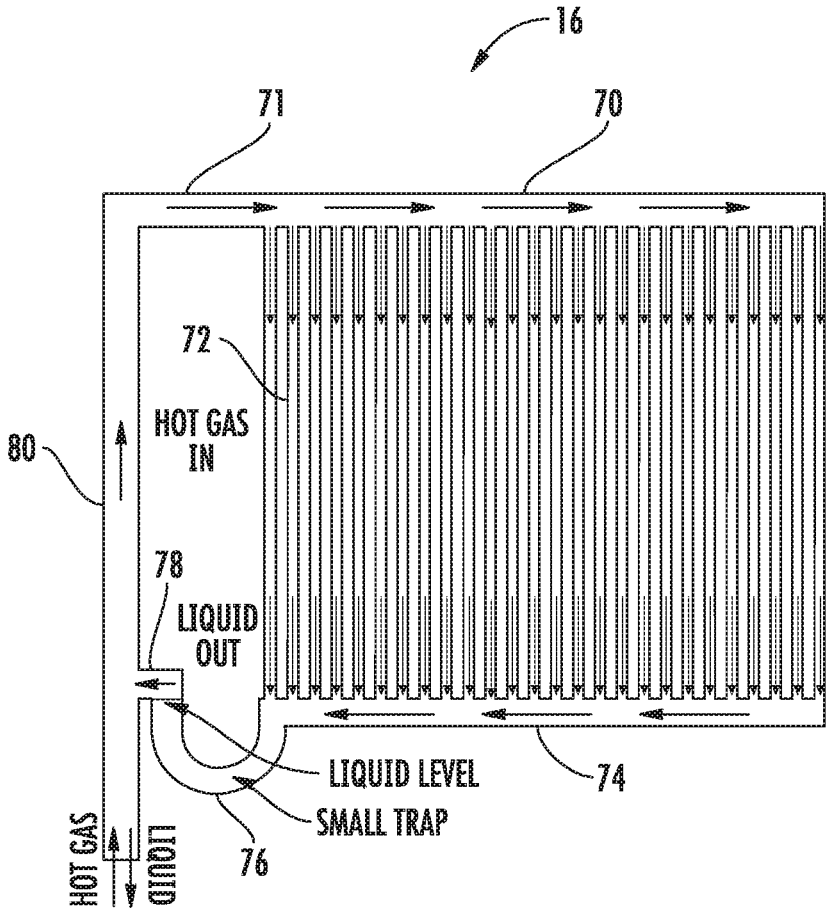

FIG. 10 depicts a condenser 16 in an alternate embodiment. In the embodiment of FIG. 10, the condenser 16 is constructed similar to that in FIG. 9, with the exception that a single pipe 80 carries both vapor refrigerant to inlet 71 and liquid refrigerant from outlet 78. The one-pipe system allows both the refrigerant vapor and liquid condensate to travel in the same pipe, thus eliminating the need for a separate condensate line and a separate vapor line. The liquid refrigerant will generally cling to the pipe walls, thus not interfering with the flow of the vapor refrigerant, which flows in the pipe center. Hence, the system piping can be much simpler, saving material costs, and reducing the likelihood of system leaks. This also eliminates the need for a check valve in the system to manage the refrigerant flow in the correct direction, as there is only one pipe in the system, and hence only one direction for flow.

Figure 11:
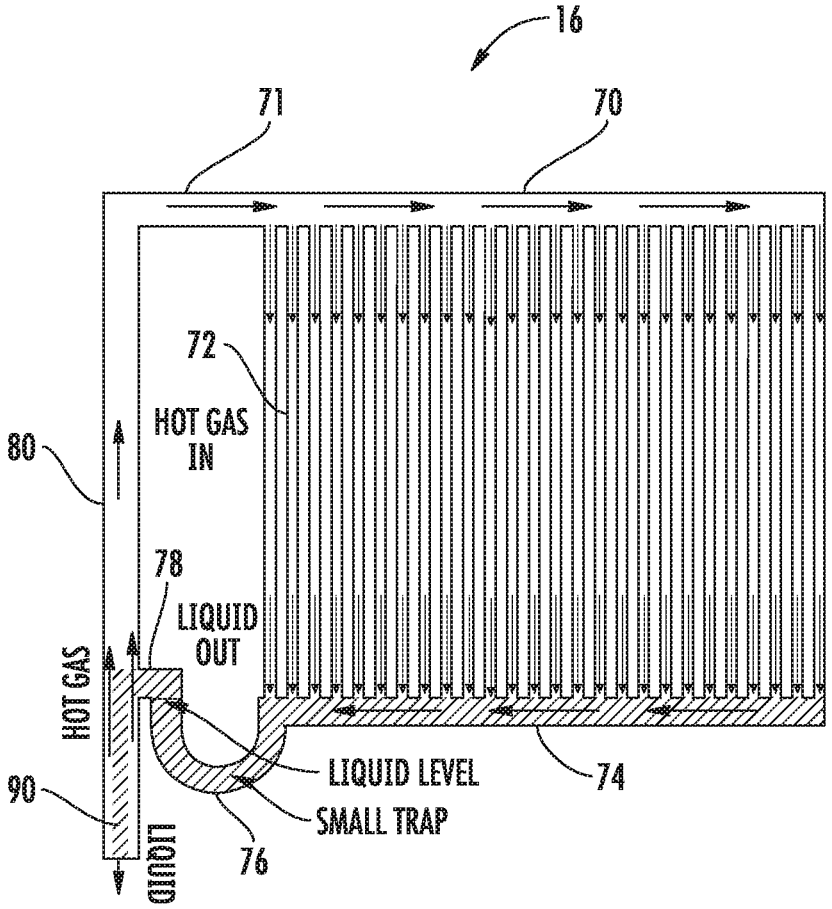

FIG. 11 depicts a condenser 16 in an alternate embodiment. In the embodiment of FIG. 11 the condenser 16 is constructed similar to that in FIG. 10, with the exception that the pipe 80 includes an internal tube 90, that is connected to outlet 78. The one-pipe system allows both the refrigerant vapor and liquid condensate to travel in the same pipe, thus eliminating the need for a separate condensate line and a separate vapor line. For a portion of the piping 80, internal tube 90 separates the vapor and fluid flows, thus eliminating any interference the opposing flows may have upon each other. This also eliminates the need for a check valve in the system to manage the refrigerant flow in the correct direction. With the one-pipe system, the vapor and liquid are allowed to flow in the same pipe. However, the liquid will be routed through a separate internal passage within a larger pipe required for the vapor flow. Hence, the flow of the condensate can be better managed as to not interfere with the vapor flow (or vise-versa). This reduces likelihood of system leak. This also eliminates the need for a check valve in the system to manage the refrigerant flow in the correct direction, as there is only one pipe in the system, and hence only one direction for flow.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A heating system comprising:

a refrigerant boiler including a heat source for heating a refrigerant from a liquid state to a vapor state, a boiler outlet and a boiler inlet, a first section and a second section arranged in counterflow manner with respect to flue gas flow from the boiler:

a heat exchanger in fluid communication with the refrigerant boiler, the heat exchanger including an upper manifold having a heat exchanger inlet coupled to the boiler outlet, a lower manifold having a heat exchanger outlet coupled to the boiler inlet and a plurality of tubes connecting the upper manifold and the lower manifold, wherein refrigerant passes from the upper manifold to the lower manifold via gravity;

a liquid-vapor separator positioned between the first section and the second section, a vapor portion of the liquid-vapor separator being coupled to an inlet of the heat exchanger, a liquid portion of the liquid-vapor separator being coupled to an inlet of the first section;

a fan moving air over the heat exchanger to define supply air for a space to be heated;

a first valve downstream of the boiler and upstream of the heat exchanger controlling flow of vapor refrigerant to the heat exchanger inlet;

a second valve downstream of the heat exchanger and upstream of the boiler controlling flow of liquid refrigerant to the boiler inlet;

and a controller for selectively opening and closing the first valve and second valve to control flow of refrigerant between the boiler and heat exchanger.

2. The heating system of claim 1 further comprising:

an accumulator positioned between the outlet of the heat exchanger and the inlet of the boiler.

3. The heating system of claim 2 further comprising:

a check valve is positioned upstream of the accumulator.

4. The heating system of claim 1 further comprising:

a receiver positioned between the outlet of the heat exchanger and the inlet of the boiler.

5. The heating system of claim 4 further comprising:

a check valve is positioned downstream of the receiver.

6. The heating system of claim 1 further comprising:

a temperature sensor positioned to monitor temperature of the supply air; and the controller receiving a temperature signal from the temperature sensor and controlling a speed of the fan in response to the temperature signal.

7. The heating system of claim 1 further comprising:
a sensor detecting an operational parameter of the refrigerant boiler;
a flue gas fan directing flue gas over a boiler heat exchanger of the refrigerant boiler; and
the controller for controlling at least one of the heat source of the refrigerant boiler and the flue gas fan in response to the sensor.

8. The heating system of claim 7 wherein:
the heat source is a staged burner having a burner stage valve to control fuel flow to an additional burner stage;
the controller controls the burner stage valve in response to the sensor.

9. The heating system of claim 7 further comprising:
a fuel flow control device to control fuel flow to the heat source;
the controller controlling the fuel flow control device in response to the sensor.

10. The heating system of claim 9 wherein:
the controller controls the fuel flow control device to one of modulate or pulsate fuel to the heat source.

11. The heating system of claim 1 further comprising:
a trap positioned between the lower manifold and the heat exchanger outlet, the trap holding liquid refrigerant.

12. The heating system of claim 1 wherein:
the heat exchanger inlet and the heat exchanger outlet are coupled to a single pipe carrying both vapor refrigerant and liquid refrigerant.

13. The heating system of claim 12 further comprising:
an internal tube coupled to the heat exchanger outlet, the internal tube positioned inside a portion of the single pipe.

14. A heating system comprising:
a refrigerant boiler including a heat source for heating a refrigerant from a liquid state to a vapor state, a boiler outlet and a boiler inlet, a first section and a second section arranged in counterflow manner with respect to flue gas flow from the boiler;
a heat exchanger in fluid communication with the refrigerant boiler, the heat exchanger including an upper manifold having a heat exchanger inlet coupled to the boiler outlet, a lower manifold having a heat exchanger outlet coupled to the boiler inlet and a plurality of tubes connecting the upper manifold and the lower manifold, wherein refrigerant passes from the upper manifold to the lower manifold via gravity;
a liquid-vapor separator positioned between the first section and the second section, a vapor portion of the liquid-vapor separator being coupled to an inlet of the heat exchanger, a liquid portion of the liquid-vapor separator being coupled to an inlet of the first section;
a fan moving air over the heat exchanger to define supply air for a space to be heated;
a first valve downstream of the boiler controlling flow of vapor refrigerant to the heat exchanger inlet;
a second valve upstream of the boiler controlling flow of liquid refrigerant to the boiler inlet;
and a controller for selectively opening and closing the first valve and second valve to control flow of refrigerant between the boiler and heat exchanger;
wherein in a first state the first valve and second valve are closed, the controller opening the first valve in response to at least one of temperature and pressure in the boiler.

15. The heating system of claim 14 wherein:
the controller opens the second valve after the first valve is opened.

16. The heating system of claim 15 wherein:
the controller closes the first valve and closes the second valve after a predetermined period of time.

17. A heating system comprising:
a refrigerant boiler including a heat source for heating a refrigerant from a liquid state to a vapor state, a boiler outlet and a boiler inlet;
a heat exchanger in fluid communication with the refrigerant boiler, the heat exchanger including an upper manifold having a heat exchanger inlet coupled to the boiler outlet, a lower manifold having a heat exchanger outlet coupled to the boiler inlet and a plurality of tubes connecting the upper manifold and the lower manifold, wherein refrigerant passes from the upper manifold to the lower manifold via gravity;
a fan moving air over the heat exchanger to define supply air for a space to be heated;
a first valve downstream of the boiler controlling flow of vapor refrigerant to the heat exchanger inlet;
a second valve upstream of the boiler controlling flow of liquid refrigerant to the boiler inlet;
and a controller for selectively opening and closing the first valve and second valve to control flow of refrigerant between the boiler and heat exchanger;
wherein the boiler includes a first section and a second section arranged in a counterflow manner with respect to flue gas flow from the boiler, the second heat exchanger section including a tray for collecting flue gas condensate and a condensate drain coupled to the tray; and a liquid-vapor separator positioned between the first section and the second section, a vapor portion of the liquid-vapor separator being coupled to an inlet of the heat exchanger, a liquid portion of the liquid-vapor separator being coupled to an inlet of the first section.

18. A heating system comprising:
a refrigerant boiler including a heat source for heating a refrigerant from a liquid state to a vapor state, a boiler outlet and a boiler inlet, a first section and a second section arranged in counterflow manner with respect to flue gas flow from the boiler;
a heat exchanger in fluid communication with the refrigerant boiler, the heat exchanger including an upper manifold having a heat exchanger inlet coupled to the boiler outlet, a lower manifold having a heat exchanger outlet coupled to the boiler inlet and a plurality of tubes connecting the upper manifold and the lower manifold, wherein refrigerant passes from the upper manifold to the lower manifold via gravity;
a liquid-vapor separator positioned between the first section and the second section, a vapor portion of the liquid-vapor separator being coupled to an inlet of the heat exchanger, a liquid portion of the liquid-vapor separator being coupled to an inlet of the first section;
a fan moving air over the heat exchanger to define supply air for a space to be heated;
a first valve downstream of the boiler controlling flow of vapor refrigerant to the heat exchanger inlet;
a second valve upstream of the boiler controlling flow of liquid refrigerant to the boiler inlet;
and a controller for selectively opening and closing the first valve and second valve to control flow of refrigerant between the boiler and heat exchanger;
a sensor detecting an operational parameter of the refrigerant boiler;
a flue gas fan directing flue gas over a boiler heat exchanger of the refrigerant boiler; and the controller for controlling at least one of the heat source of the refrigerant boiler and the flue gas fan in response to the sensor;

wherein the flue gas fan is one of a two speed fan, a variable speed fan, and multiple fans, controlled by the controller in response to the sensor.

* * * * *